US010927330B2

(12) United States Patent
Venet et al.

(10) Patent No.: US 10,927,330 B2
(45) Date of Patent: Feb. 23, 2021

(54) COATED DETERGENT TABLET

(71) Applicant: EUROTAB, St Just St Rambert (FR)

(72) Inventors: Valerie Venet, Orlienas (FR); Jacques Brosse, La Grand Croix (FR); Sandrine Arnaud, Saint Marcellin en Forez (FR)

(73) Assignee: EUROTAB, St. Rambert (FR)

( * ) Notice: Subject to any disclaimer, the term of this patent is extended or adjusted under 35 U.S.C. 154(b) by 0 days.

(21) Appl. No.: 15/781,076

(22) PCT Filed: Dec. 2, 2016

(86) PCT No.: PCT/FR2016/053192
§ 371 (c)(1),
(2) Date: Jun. 1, 2018

(87) PCT Pub. No.: WO2017/093694
PCT Pub. Date: Jun. 8, 2017

(65) Prior Publication Data

US 2018/0371383 A1 Dec. 27, 2018

(30) Foreign Application Priority Data

Dec. 4, 2015 (FR) ..... 1561859

(51) Int. Cl.
*C11D 17/00* (2006.01)
*C11D 3/20* (2006.01)
*C11D 3/37* (2006.01)
*C11D 11/00* (2006.01)

(52) U.S. Cl.
CPC ..... *C11D 17/0082* (2013.01); *C11D 3/2065* (2013.01); *C11D 3/3707* (2013.01); *C11D 3/378* (2013.01); *C11D 3/3753* (2013.01); *C11D 3/3761* (2013.01); *C11D 11/0023* (2013.01)

(58) Field of Classification Search
CPC ..... C11D 17/0082
See application file for complete search history.

(56) References Cited

U.S. PATENT DOCUMENTS 3,231,505 A 1/1966 Farrar
5,759,988 A * 6/1998 Heile ..... C11D 1/521 510/108
5,916,866 A 6/1999 Davies et al.
6,448,323 B1 * 9/2002 Jordan ..... C08K 3/34 524/145
2004/0014631 A1 * 1/2004 Weber ..... B05C 9/02 510/446
2004/0081690 A1 * 4/2004 Gauthier ..... C11D 3/3761 424/465
2005/0152855 A1 * 7/2005 Hajduk ..... A61K 8/22 424/53
2010/0279914 A1 * 11/2010 Belten-Casteel ..... C11D 3/222 510/224

FOREIGN PATENT DOCUMENTS

EP 0979862 A1 2/2000
EP 1149896 A1 10/2001
EP 1305393 B1 2/2005
EP 1903099 A1 3/2008
EP 2196531 A1 6/2010
FR 1327781 1/1966
WO 0164829 A1 9/2001
WO 0210329 A1 2/2002
WO 2004046229 A1 6/2004
WO 2014024170 A1 2/2014

OTHER PUBLICATIONS

INPI 1561859 Preliminary Research Report, (2 pages).
International Search Report, (2 pages).
European Patent Office—International Search Report of the International Searching Authority dated Feb. 3, 2017 for International Application No. PCT/FR2016/053192 with English translation (6 pgs).
European Patent Office—Written Opinion of the International Searching Authority dated Feb. 3, 2017 for International Application No. PCT/FR2016/053192 with English translation (6 pgs).

* cited by examiner

*Primary Examiner* — William D Young
(74) *Attorney, Agent, or Firm* — Womble Bond Dickinson (US) LLP

(57) ABSTRACT

The invention relates to a detergent tablet comprising a body made from compacted powder, said body being coated with a water-soluble coating, said water-soluble coating having a composition comprising a film-forming agent and water, characterised in that the composition of the water-soluble coating further comprises at least one specific agent for improving the efficiency in terms of rinsing of the detergent tablet.

28 Claims, No Drawings

COATED DETERGENT TABLET

CROSS-REFERENCE TO RELATED APPLICATION

This patent application is a U.S. National Phase application under 35 U.S.C. § 371 of International Application No. PCT/FR2016/053192, filed on 2 Dec. 2016, entitled COATED DETERGENT TABLET, which claims priority from French Application No. 1561859 filed on 4 Dec. 2015, the content of which are incorporated by reference in their entirety.

FIELD OF THE INVENTION

The present invention relates to the field of detergent tablets, notably dishwasher detergent tablets.

PRIOR ART

Detergents in tablet form have numerous advantages compared to other detergents, in liquid or powder form, notably as regards dosage, storage and transport.

Detergent tablets are most often prepared by pre-mixing various components preferentially in powder or pellet form, but also in liquid form. This premix is next compacted by means of a press to form a tablet. Industrially, rotary presses are preferably used to make it possible to form compacted tablets at high speed.

The detergency field imposes particular constraints for making tablets since certain components withstand compression poorly, other components can react together before use and thereby reduce the efficiency of the tablet during use, and that is why multilayer tablets have been developed. Indeed, such multilayer tablets make it possible both to separate components capable of reacting with each other, and to only compress a single time pressure-sensitive components by inserting them in the final layer. Multilayer tablets may have slightly delayed disintegrations between the different layers, the first layer having been compressed several times generally has a longer disintegration than the following, less compressed layers.

One of the recurring problems in the field of detergent tablets is the resistance of these tablets over time, notably so that they can be handled and transported without then crumbling or disintegrating.

In this respect, it has been proposed to coat detergent tables with a coating or a film, in order to reinforce the resistance of the tablets. Such teaching is for example found in a patent of the Colgate Palmolive company published in 1966 under the reference U.S. Pat. No. 3,231,505, in which it is proposed to coat the detergent tablet with a film of synthetic organic polymer, for example polyvinyl alcohol (PVA), in order to increase the resistance to abrasion and accidental rupture of the tablet.

In a similar manner, the international patent application of PROCTER & GAMBLE published in 2001 under the reference WO 01/64829 relates to the coating of detergent tablets with a water-dispersible coating composed for example of PVA, to make it possible to produce tablets having a solidity and a mechanical strength similar to traditional tablets while being less compacted and thus able to be dissolved more rapidly.

Another patent, in the name of Dalli-Werke GmbH and Co. KG, published under the reference EP 2 196 531, describes a coating for detergent tablets, such as dishwasher tablets, making it possible to increase the stability and the mechanical strength of the tablet, said coating being water soluble and containing at least one grafted copolymer of polyvinyl alcohol and polyethylene glycol.

The coatings proposed in these documents for coating the detergent tablets are provided to increase the stability of said tablets while forming a layer that mechanically maintains the detergent composition compacted. However, they are complex to implement, can denature the action of the detergent tablet or reduce the efficiency and/or the disintegration of the detergent tablet.

An aim of the present invention is to propose a detergent tablet, notably for a dishwasher application, having improved efficiency, mechanical strength and stability allowing the tablet to be able to be handled and stored without undergoing degradation.

An aim of the present invention is also to propose a detergent tablet, notably for a dishwasher application, having an improved action while having a method of manufacture that is simple to implement.

DESCRIPTION OF THE INVENTION

To this end, a detergent tablet is proposed comprising a body made from compacted powder, said body being coated with a water-soluble coating, said water-soluble coating having a composition comprising a film-forming agent and water, characterised in that the composition of the water-soluble coating further comprises at least one specific agent for improving the efficiency in terms of rinsing of the detergent tablet.

Preferred but non-limiting aspects of this detergent tablet, taken alone or in combination, are the following:

- the water-soluble coating has a thickness comprised between 1 μm and 1,000 μm, preferably comprised between 5 μm and 300 μm, and further preferably comprised between 15 μm and 150 μm.
- the water-soluble coating has a weight representing between 0.5% to 15% by weight compared to the total weight of the detergent tablet, preferably between 2% to 5% by weight compared to the total weight of the detergent tablet.
- the specific agent for improving the efficiency in terms of rinsing is an anti-spotting and/or anti-filming agent.
- the at least one specific agent is in a proportion comprised between 0.05% and 50% by weight compared to the total weight of the composition of the water-soluble coating, preferably between 2% and 20% by weight compared to the total weight of the composition of the water-soluble coating.
- the at least one specific agent is a polymer.
- the at least one specific agent is selected from modified hydrophobic acrylic/styrene copolymers, or combinations thereof.
- the at least one specific agent is selected from copolymers of acrylic acid and sulphonated monomer, copolymers of acrylic acid and sulphonic acid, copolymers of acrylic acid and maleic acid, or combinations thereof.
- the at least one specific agent is selected from carboxylate polymers, modified hydrophobic carboxylate polymers, in particular HASE polymers, and combinations thereof.
- the film-forming agent is in a proportion comprised between 5% and 80% by weight compared to the total weight of the composition of the water-soluble coating, preferably comprised between 20% and 60% by weight compared to the total weight of the composition of the water-soluble coating, and further preferably comprised between 30% and 55% by weight compared to the total weight of the composition of the water-soluble coating.

the film-forming agent is selected from polyvinyl alcohols, preferably from polyvinyl alcohols having a hydrolysis level with a molar percentage greater than or equal to 40%, preferably comprised between 70% and 98%, and further preferably comprised between 80% and 90%.

the film-forming agent is selected from polyvinyl alcohols having a molar mass by weight comprised between 10,000 g/mol and 200,000 g/mol, and preferably comprised between 15,000 g/mol and 100,000 g/mol the composition of the water-soluble coating further comprises a humectant.

the humectant is in a proportion less than or equal to 25% by weight compared to the total weight of the composition of the water-soluble coating, preferably in a proportion comprised between 1% and 20% by weight compared to the total weight of the composition of the water-soluble coating, further preferably in a proportion comprised between 2% and 10% by weight compared to the total weight of the composition of the water-soluble coating.

the humectant is selected from glycerine, polyethylene glycols, and combinations thereof.

the humectant is selected from polyethylene glycols having a molar mass by weight comprised between 1,000 g/mol and 4,000 g/mol.

DETAILED DESCRIPTION OF THE INVENTION

A detergent product is thus proposed in the form of a tablet coated with a coating, formed of a water-soluble solution, making it possible to cover the surface of the tablet while forming a homogeneous film adhering to the surface of the tablet. The detergent product in tablet form may for example be a dishwasher detergent.

The proposed detergent tablet comprises a body made for example from compacted powder, said body being coated with a water-soluble coating. The water-soluble coating used has a composition comprising a film-forming agent and water, and has the particularity of further comprising at least one specific agent for improving the efficiency in terms of rinsing of the detergent tablet. As will be seen later, the composition of the water-soluble coating may further comprise a humectant.

The specific agent used to improve the rinsing efficiency of the detergent tablet is preferably selected from compounds having an "anti-spotting" action and/or an "anti-filming" action.

"Spotting" is taken to mean any trace on a washing up element, caused by the drying of drops of water on the surface of the material forming the washing up element, in particular glass. Calcium and magnesium present in the water may for example be deposited on the surface of the glass and form traces during drying in the dishwasher. The harder the water, the more calcium and magnesium ions it contains.

"Filming" is taken to mean any appearance of a white film/deposit on the whole or on a large part of the surface of the material forming the washing up element, in particular the opacification of glass. Calcium and magnesium ions present in the water may for example form more or less uniform lime deposits on the surface of the glass.

As will be seen hereafter in this description, the use of a specific agent provided to improve the efficiency in terms of rinsing of the detergent tablet, such as an anti-spotting and/or anti-filming agent, in the composition forming the coating covering the detergent tablet, makes it possible to have enhanced stability compared to existing coated tablets.

Providing such a specific agent in the composition forming the coating covering the detergent tablet is also particularly advantageous since it makes it possible notably to use agents that are generally in liquid form and which are thus generally difficult to use in tablet detergent formulas. Indeed, specific agents in liquid form are generally difficult to introduce into the powdery mixture intended to be compacted, and moreover lead to problems of stability of the final compacted tablet, in particular due to the water present in such specific agents in liquid form that can react with the other raw materials of the detergent formula.

Detergent Product in Tablet Form

The detergent product used is preferably in the form of a tablet that has sufficient cohesion to be able to be handled without being broken and which disintegrates easily in water.

The tablet does not need to have great hardness, its cohesion and mechanical strength being notably reinforced by the use of a coating that coats the tablet, that is to say adhering to the surface of the tablet.

The tablet has a body formed by compaction for example, notably from a mixture of raw materials in powder or pellet form, but also in liquid form.

Detergent tablets are constituted of a mixture of components comprising different actions, these components being able for example to be selected from surfactants, fillers, sequestrants, bleaching agents, enzymes, bleaching activators, alkaline agents, polymers, fragrances, colorants.

The detergent tablet may be constituted of a single layer or a stack of several layers which are superimposed on each other, thereby forming a uniform and compact block. For a multilayer tablet, the different layers may have an identical or different composition.

The tablet preferably has an elongated shape with a section having any shape, for example circular, oval, octagonal, or parallelepiped.

When the section of the tablet is parallelepiped, typically square or rectangular, the corners of the tablet may be rounded in such a way that they are less easily broken.

Each layer preferably has the same section such that the stack of layers forms a uniform tablet.

The detergent tablet preferably has a weight comprised between 1 gramme and 100 grammes, and further preferably comprised between 5 grammes and 60 grammes.

The tablet preferably has a mechanical strength comprised between 5 Newtons and 300 Newtons, and further preferably between 10 Newtons and 90 Newtons.

To form a multilayer tablet, the manufacturing process generally used consists in progressively forming a complex of several layers and in compacting said complex at each new addition of a layer in such a way as to solidify the tablet. The tablets are manufactured by direct compression with a hydraulic press or a rotatory press, notably when it is wished to form tablets at industrial speed.

The first step thus consists in mixing the components intended to form the compositions corresponding to each of the layers. The mixture corresponding to the first layer is introduced into the matrix then pre-compacted to form the first layer. The mixture of the second layer is next introduced into the matrix on the first layer then pre-compacted as for the first layer, in the same way the other layers of the tablet are introduced into the matrix. The series of layers is next compacted to obtain an impact resistance tablet.

The pre-compaction forces used are preferably comprised between 0 kN and 100 kN (kiloNewtons), and further preferably between 0 kN and 50 kN. The compressive force used for the final compaction is preferably comprised between 5 kN and 200 kN, and further preferably between 10 kN and 100 kN.

A dishwasher detergent tablet comprising a combination of one or more of the components is described in greater detail below, without this being limiting.

Enzymes

To enable the degradation of soiling present on the washing up, the tablet preferably contains enzymes in order to form an enzymatic system. These enzymes are for example selected from proteases, amylases, lipases, and combinations thereof.

These enzymes generally come in the form of pellets which contain a certain amount of active enzymes.

The detergent tablets that are preferentially used have an overall composition integrating enzymes of which the total amount of active enzymes is comprised between 0.003% and 5% by weight, and preferably between 0.003% and 2% by weight.

It is possible to use amylases to decompose starch based stains, such as for example the product distributed by the Genencor company under the reference "Powerase 16000HS".

The tablet may further contain proteases to act on protein stains such as meat and eggs. It is possible for example to use the product referenced "Excellase 2250D" distributed by the Genencor company.

The tablet may further contain lipases in order to improve the degradation of grease stains present on the washing up.

Bleaching Agent and Bleaching Agent Activators

To enable the degradation of oxidisable stains such as tea, coffee and red wine, the tablet preferably contains a bleaching agent, that is to say a substance capable of directly or indirectly oxidising the organic compounds described.

The bleaching agents could be of the type mono- or tetra-hydrated sodium perborate, sodium percarbonate, sodium persilicate, and sodium persulphate.

In alkaline medium, these compounds release hydrogen peroxide in contact with water, thereby generating an active oxygen source.

The tablet preferably comprises between 1% and 50% by weight of bleaching agent, and further preferably between 5% and 20% by weight.

In order to enable even more efficient bleaching of the washing up, the tablet preferably contains a bleaching agent activator of tetraacethylenediamine (TAED), pentaacetylglucose (PAG), tetraacethylglycoluryl (TAGU) and sodium sulfonate benzoloxybenzene type.

These activators react in the washing bath with hydrogen peroxide, giving chemical compounds of which the performance on organic soiling is enhanced, notably for chemical affinity reasons.

The tablet preferably comprises between 0.5% and 40% by weight of bleaching agent activator, and further preferably between 1% and 10% by weight.

Preferably, the tablet comprises a ratio between bleaching agents and bleaching agent activators corresponding to a molar ratio of 6 to 1, further preferably a molar ratio of 5 to 1.

The tablet may further contain catalysts making it possible to improve the efficiency of agents on oxidisable stains. It is possible to cite for example manganese catalysts such as the product referenced "Peractive FDO X" sold by the Weylchem company.

Detergency Adjuvants/Sequestrants (or Builders)

Washing efficiency will be increased if the tablet further comprises detergency adjuvants, also known as "builders".

Detergency adjuvants trap metal ions such as the calcium and magnesium ions present in the washing solution by complexation, ion exchange or precipitation.

Detergency adjuvants are preferentially present at a level of 5% to 99% by weight, and further preferably 10% to 50% by weight.

The non-phosphorous water-soluble detergency adjuvants may be organic or inorganic.

The inorganic compounds that may be present are selected from zeolites, phyllosilicates, alkali metal (generally sodium) carbonates, and sodium silicates, mixtures of sodium carbonate and sodium silicates such as the product referenced "Questlock" distributed by the Amcol company.

The organic compounds that may be present are selected from polycarboxylate polymers such as polyacrylates, acrylic/maleic copolymers and acrylic phosphonates, polycarboxylate monomers such as citrates, gluconates, oxydisuccinates, mono-, di- and tri-succinates of glycerol, carboxymethyloxysuccinates, polycarboxylic amino compounds such as carboxymethyloxymalonates of methylglycinediacetate acid (MGDA), glutamic diacetic acid (GLDA), imminodisuccinate (IDS), ethylenediamine disuccinate (EDDS), dipicolinates, nitrilotriacetates and hydroxyethyliminodi acetates.

Sodium citrate and methylglycinediacetate acid (MGDA) are particularly preferred detergency adjuvants for dishwasher tablets.

The class of phosphorous-containing water-soluble adjuvants comprises alkali metal orthophosphates, meta-phosphates, pyrophosphates and polyphosphates.

Specific examples of inorganic phosphorous-containing detergency adjuvants comprise sodium and potassium tripolyphosphates, orthophosphates and hexametaphosphates.

Sodium tripolyphosphate is a particularly preferred phosphorous based adjuvant for dishwasher tablets. It exists in hydrated, anhydrous or partially hydrated form and it is possible to use mixtures of these forms in order to regulate the speed of disintegration and dissolution of the tablet.

To enable efficient washing of the washing up, the pH of the washing solution has to be at least 9 and preferably comprised between 9.5 and 12.5. Most detergency adjuvants are alkaline, such that it is not necessary to add other compounds to the tablet to adjust the pH.

Surfactants

For efficient washing, the tablet preferably contains one or more non-ionic surfactants, for example low foam non-ionic surfactants. Surfactants are amphiphilic molecules, which are composed of an apolar lipophilic part and a polar hydrophilic part.

For dishwasher detergent tablets, the amount of surfactants in the tablet is preferably comprised between 0.05% and 20% by weight, and further preferably between 1% and 5% by weight.

Surfactants in solid form are easier to use in tablets which also have solid compositions. However, when the surfactant is in liquid form, it may also be introduced into the tablet, in which case it is adsorbed on supports such as sodium carbonate or silica.

Synthetic non-ionic surfactants may generally be defined as compounds derived from the condensation between alkylene oxide groups and hydrophobic organic compounds, which can be aliphatic or aromatic. The length of the hydrophilic part of the surfactant may be easily adjusted in order to obtain a water-soluble compound having the desired HLB, HLB designating the Hydrophilic-Lipophilic Balance of the surfactant.

The non-exhaustive list of non-ionic surfactants that may be used in the tablet encompasses ethoxylated and/or propoxylated fatty alcohols, copolymers of ethylene oxide and propylene oxide, alkyl polyglucosides and modified polyglycolether fatty alcohols.

It is also possible to use anionic surfactants, notably to improve drying of the washing up for the dishwasher tablets. In this case, the amount of anionic surfactants present in the tablet is preferably comprised between 0.05% and 40% by weight, and preferably between 1% and 20% by weight.

The non-exhaustive list of anionic surfactants that may be used in the detergent tablets encompasses alkylbenzenesulphonates, paraffin or alkanesulphonates, primary alcohol sulphates, α-olefinsulphonates, alkyl ether sulphates, sulphosuccinates, acyl isethionates, methyl ester sulphonates, soap, sulphoalkylamides of fatty acids, diglycolamide sulphates, N-acyl amino acids, and alkyl polyoxyethylene carboxylates.

Additional Components

Apart from these basic components of the detergent tablet, said tablet may comprise additional components that will be used according to the desired specificities of the detergent tablet.

It is possible for example to use protective additives, such as for example benzotriazole and zinc salts. These additives form a system that protects the washing up and the dishwasher from undesired chemical attacks coming from one or the other of the components of the tablet.

Chelating agents intended to trap metal ions may further be present in the composition. They are also known as sequestrants or metal ion complexing agents. If need be, it is preferable that the amount of chelating agents is of the order of 0.5% to 20% by weight, and preferably 0.5% to 5% by weight. Preferred chelating agents comprise organic phosphonates substituted in a polyfunctional manner and mixtures thereof. It is also possible to use homopolymers of acrylic acid or copolymers of acrylic and maleic acid.

Break-up agents may also be used, which have the aim of accelerating the disintegration of the layer in which they are incorporated. Preferred break-up agents comprise carboxymethylcellulose, cross-linked carboxymethylcellulose, sodium croscarmellose, cellulose, polyvinylpyrrolidone and mixtures thereof.

It is also possible to add colorants to differentiate the layers from one another. These colorants essentially have the aim of improving the aesthetic appearance of the tablet vis-à-vis the consumer.

It is also possible to add fragrance to mask unpleasant smells when the dishwasher is opened.

It is also possible to add pelletizing additives such as binders which make it possible to increase the hardness of the lozenge and to reduce its friability. Among the binders that can be used, it is notably possible to cite polyethylene glycols.

Lubricants may also be used to facilitate the ejection of the tablet at the outlet of the rotatory press. Among lubricants that may be used, it is possible to cite alkali metal stearates such as calcium stearate and magnesium stearate.

Other additives could be used such as for example anti-foaming agents.

Water-Soluble Coating Covering the Body of the Detergent Tablet

Once the main body constituting the detergent tablet is formed, a particular solution is used to form the water-soluble coating intended to cover the surface of the tablet.

As will be seen later in the comparative tests, this coating that covers the body of the detergent tablet has other advantages than that of protecting the body against impacts and against the humidity present in ambient air. Indeed, it is going to make it possible for example to improve the action of the detergent tablet, notably as regards rinsing. It is moreover going to contribute to the overall stability of the detergent tablet while offering better disintegration and low friability of the body.

As indicated above, the solution used to form the water-soluble coating contains a film-forming agent, water and a specific agent intended to improve the efficiency in terms of rinsing of the detergent tablet.

As film-forming agent, the solution may for example comprise polyvinyl alcohol (PVA).

The PVA that may be used preferably has a hydrolysis level greater than or equal to 40% (% molar), preferably comprised between 70% and 98% (% molar), and further preferably a hydrolysis level comprised between 80% and 90%.

The PVA used preferably has a molar mass by weight (Mw) comprised between 10,000 g/mol and 200,000 g/mol, and further preferably between 15,000 g/mol and 100,000 g/mol. The molar mass by weight of PVA strongly impacts the final viscosity of the coating solution.

For example the PVA sold under the reference "Mowiol" by the Clariant company, such as more particularly the products referenced "Mowiol 4-88" or "Mowiol 8-88" could be used.

The coating solution may contain PVA in a proportion comprised between 5% and 80% by weight compared to the total weight of the coating solution, preferably between 20% and 60% by weight compared to the total weight of the coating solution, and further preferably between 30% and 55% by weight compared to the total weight of the coating solution.

A humectant may further be used in the solution to form the water-soluble coating. Humectants notably make it possible to avoid water migrating into the tablet.

Such a humectant is for example selected from glycerine, polyethylene glycols, and combinations thereof.

Among the polyethylene glycols that may be used, those of which the molar mass by weight is comprised between 1,000 g/mol and 4,000 g/mol will be selected preferentially.

The coating solution may contain humectants in a proportion less than or equal to 25% by weight compared to the total weight of the coating solution, preferably in a proportion comprised between 1% and 20% by weight compared to the total weight of the coating solution, and further preferably a proportion comprised between 2% and 10% by weight compared to the total weight of the coating solution.

The specific agent making it possible to improve the efficiency in terms of rinsing is preferably an anti-spotting and/or anti-filming agent.

The anti-spotting agents make it possible to eliminate or to limit the appearance of spotting, that is to say traces, notably by avoiding the nucleation of drops of water on the surface of the glass or the washing up.

Anti-filming agents make it possible to limit or eliminate the appearance of filming, that is to say the appearance of a film or white deposit.

The coating solution preferably contains specific agents in a proportion comprised between 0.05% and 50% by weight compared to the total weight of the coating solution, and further preferably between 2% and 20% by weight compared to the total weight of the coating solution.

Preferably, the specific agents making it possible to improve the efficiency in terms of rinsing are specific polymers, preferably polymers having an anti-spotting and/or anti-filming action.

As anti-spotting agent, it is possible for example to select a compound from carboxylate polymers, modified hydrophobic carboxylate polymers, in particular HASE polymers, and combinations thereof. It is possible for example to use one of the products sold by the Dow Chemical company under the references "Acusol 820", "Acusol 460", or "Acusol 460ND".

As anti-spotting agent, it is also possible to select a compound from modified hydrophobic acrylic/styrene copolymers. It is possible for example to use one of the products sold by the AkzoNobel company under the references "Alcosperse 725", "Alcosperse 747", or "Alcosperse 747D".

As anti-filming agent, it is possible for example to select a compound from copolymers of acrylic acid and sulphonated monomer. It is possible for example to use one of the products sold by the AkzoNobel company under the references "Alcopserse 240", "Alcosperse 240D", "Alcoguard 4100D", "Alcoguard 4160", or "Alcoguard 4160".

As anti-filming agent, a compound may also be selected from copolymers of acrylic acid and sulphonic acid. It is possible for example to use the product sold by the Dow Chemical company under the reference "Acusol 588G".

As anti-filming agent, it is also possible to select a compound from copolymers of acrylic acid and maleic acid. It is possible for example to use the product referenced "Acusol 497NG" sold by the Dow Chemical company, the product referenced "Alcosperse 175ND" sold by the AkzoNobel company, or the product referenced "Sokalan CP42" sold by the BASF company.

The coating solution may further contain an embittering agent such as denatonium benzoate and/or fragrance.

The remainder of the solution is water.

The different compounds are mixed at ambient temperature in order to form the solution intended to form the coating of the detergent tablet.

The mixture obtained is for example sprayed on the surface of the body forming the detergent tablet, preferably at ambient temperature by means of a nozzle system.

The thickness of the coating deposited on the surface of the detergent tablet is comprised for example between 0.05 μm and 1,000 μm, preferably between 5 μm and 300 μm, and further preferably between 15 μm and 150 μm.

The water-soluble coating deposited on the tablet represents preferably between 0.5% and 15% of the total weight the detergent tablet, and further preferably between 2% and 5% of the weight of the tablet.

Comparative Tests

Test 1: Spraying of the Coating Solution on a Tablet

The objective of this test is to compare the disintegration time and the friability of a coated tablet, that is to say coated with a water-soluble coating, and a non-coated tablet, that is to say without a coating.

The compounds used in the formula of each tablet are spread out in three layers. These compounds are indicated in table 1 below.

The different layers of the tablet are compressed on a hydraulic press in such a way as to form a tablet having an overall weight of 16 g. The pre-compressive and compressive forces used are indicated in table 3 below.

The formulas produced are set out in table 1 below.

TABLE 1

| Raw material | Tablet n°1 Non-coated tablet (% by weight) | Tablet n°2 Coated tablet (% by weight) |
|---|---|---|
| Sodium carbonate | 18.98 | 18.96 |
| Sodium chloride | 18.46 | 22.87 |
| Sodium citrate | 17.32 | 17.32 |
| Blue colorant | 0.01 | 0.00 |
| Yellow colorant | 0.01 | 0.00 |
| Glucopon 50G (Non-ionic surfactant sold by the BASF company) | 1.34 | 1.34 |
| Sodium hedphosphonate | 0.49 | 0.49 |
| Acrylic homopolymer | 0.86 | 0.85 |
| Arbocel TF0210 (sold by the JRS Rettenmeier company) | 0.61 | 0.00 |
| Sodium percarbonate | 13.03 | 13.03 |
| PEG 1500 (polyethylene glycol) | 4.76 | 1.00 |
| Sodium silicate | 4.92 | 4.92 |
| Sodium sulphate | 13.52 | 13.52 |
| TAED | 3.19 | 3.19 |
| Glycerine | 0.78 | 0.78 |
| Amylase | 0.20 | 0.20 |
| Dehypon GRA (Non-ionic surfactant sold by the BASF company) | 0.33 | 0.33 |
| TOTAL | 100.00 | 100.00 |

As revealed by Table 1, the coated tablet (tablet n°2) is identical to the non-coated tablet (tablet n°1), except for the following ingredients:

PEG 1500, which is a pelletizing additive (binder): 1% versus 4.76%

Arbocel TF0210, which is a disintegrating agent: 0% versus 0.61%

For the coated tablet, the composition of the solution to form the water-soluble coating is summarised in table 2 below. A uniform coating of a total weight of 0.4 g is deposited on the surface of the tablet so as to form a coating.

TABLE 2

| Raw material | Coating solution (% by weight) |
|---|---|
| Polyvinyl alcohol | 45.84 |
| Water | 47.91 |
| Glycerine | 0 |
| Acusol 460 ND | 6.25 |

Once the two types of tablets have been formed, several comparative tests were carried out, to measure notably the hardness, the disintegration and the friability of the tablets.

The hardness of the tablets was measured on an MTS type hardness tester.

The disintegration time of the tablets obtained was measured on an apparatus that moves back and forward with a frequency of 60 times/min. The tablets are placed in a basket provided with multiple holes to allow water to drain. The baskets are then immersed in 1.8 L beakers of water at 30° C. The disintegration time is noted once the tablet has completely disintegrated and there are no longer tablet residues in the basket.

The friability of the tablets is measured on the friability test device bearing the reference "FT2" and sold by the SOTAX company, with the following rotation parameters:

number of turns: 50 speed: 25 turns/min

The results of the comparative tests are summarised in table 3 below.

TABLE 3

| | Pre-compressive force (kN) | Compressive force (kN) | Hardness tablet (N) | Disintegration time (min) | % Friability |
|---|---|---|---|---|---|
| Tablet n°1 (non-coated) | 20 | 60 | 90 | 7 | 12 |
| Tablet n°2 (coated) | 10 | 40 | 32 | 3 | 0.2 |

It may be observed with the results of the comparative tests summarised in table 3 that the use of the water-soluble coating makes it possible:

- to reduce the amount of pelletizing additive (binder, disintegrating agent) in the formula;
- to reduce the pre-compressive and compressive forces on the presses;
- to reduce the disintegration time of the tablets;
- while obtaining less friable tablets, that is to say more stable over time, notably under storage conditions.

Test 2: Use of an Anti-Spotting Agent in the Coating Solution for Improving the Efficiency in Terms of Rinsing of a Dishwasher Tablet The objective of this test is to evaluate the influence of the use of a coating integrating an anti-spotting agent on the efficiency in terms of rinsing of the tablets.

Comparative measurements were carried out on the following dishwasher tablets:

- a non-coated dishwasher tablet with the anti-spotting agent in the central layer (tablet n°3);
- a coated dishwasher tablet with the anti-spotting agent in the central layer, where the coating solution does not contain the anti-spotting agent. The coating solution is composed of polyvinyl alcohol and water (tablet n°4);
- a coated dishwasher tablet with the anti-spotting agent in the central layer, where the coating solution does not contain the anti-spotting agent. The coating solution is composed of polyvinyl alcohol, water, and a humectant (tablet n°5);
- a dishwasher tablet coated with a coating solution containing the anti-spotting agent, where the formulation of the tablet does not contain the anti-spotting agent. The coating solution is composed of polyvinyl alcohol, water, and the anti-spotting agent (tablet n°6)
- a dishwasher tablet coated with a coating solution containing the anti-spotting agent, where the formulation of the tablet does not contain the anti-spotting agent.

The coating solution is composed of polyvinyl alcohol, water, a humectant and the anti-spotting agent (tablet n°7).

The anti-spotting agent used for this comparative test is the product referenced "Acusol 460ND" sold by the Dow Chemical company.

The compounds used in the formula of each tablet are spread out in three layers. The compounds of the different layers are indicated in tables 4a, 4b and 4c below.

The different layers of the tablet are compressed on a hydraulic press so as to form a tablet having an overall weight of 16 g. The pre-compressive and compressive forces used are indicated in table 6 below.

TABLE 4a

| Ingredients LAYER 1 | Tablet n°3 (% by weight of the layer) | Tablet n°4 (% by weight of the layer) | Tablet n°5 (% by weight of the layer) | Tablet n°6 (% by weight of the layer) | Tablet n°7 (% by weight of the layer) |
|---|---|---|---|---|---|
| SODIUM CARBONATE | 11.80 | 11.80 | 11.80 | 11.80 | 11.80 |
| TRISODIUM CITRATE | 40.45 | 40.45 | 40.45 | 40.45 | 40.45 |
| SODIUM PERCARBONATE | 23.27 | 23.27 | 23.27 | 23.27 | 23.27 |
| SODIUM CHLORIDE | 14.56 | 14.56 | 14.56 | 14.56 | 14.56 |
| LUTENSOL AT50 (Non-ionic surfactant sold by the BASF company) | 2.98 | 2.98 | 2.98 | 2.98 | 2.98 |
| ARBOCEL TF 0210 | 0.86 | 0.86 | 0.86 | 0.86 | 0.86 |
| PEG 1500 | 5.00 | 5.00 | 5.00 | 5.00 | 5.00 |
| SODIUM HEDPHOSPHONATE | 0.88 | 0.88 | 0.88 | 0.88 | 0.88 |
| GLYCERINE | 0.20 | 0.20 | 0.20 | 0.20 | 0.20 |
| TOTAL LAYER 1 | 100.00 | 100.00 | 100.00 | 100.00 | 100.00 |

TABLE 4b

| Ingredients LAYER 2 | Tablet n°3 (% by weight of the layer) | Tablet n°4 (% by weight of the layer) | Tablet n°5 (% by weight of the layer) | Tablet n°6 (% by weight of the layer) | Tablet n°7 (% by weight of the layer) |
|---|---|---|---|---|---|
| SODIUM CARBONATE | 11.77 | 11.77 | 11.77 | 11.77 | 11.77 |
| TRISODIUM CITRATE 2(H2O) | 40.45 | 40.45 | 40.45 | 40.45 | 40.45 |
| SODIUM PERCARBONATE | 23.27 | 23.27 | 23.27 | 23.27 | 23.27 |
| SODIUM CHLORIDE | 13.98 | 13.98 | 13.98 | 14.56 | 14.56 |
| LUTENSOL AT50 (Non-ionic surfactant sold by the BASF company) | 2.98 | 2.98 | 2.98 | 2.98 | 2.98 |
| ARBOCEL TF 0210 | 0.86 | 0.86 | 0.86 | 0.86 | 0.86 |
| PEG 1500 | 5.00 | 5.00 | 5.00 | 5.00 | 5.00 |
| SODIUM HEDPHOSPHONATE | 0.88 | 0.88 | 0.88 | 0.88 | 0.88 |
| ACUSOL 460ND | 0.58 | 0.58 | 0.58 | 0 | 0 |
| COLORANT TARTRAZINE E102 MD LA | 0.03 | 0.03 | 0.03 | 0.03 | 0.03 |
| GLYCERINE | 0.20 | 0.20 | 0.20 | 0.20 | 0.20 |
| TOTAL layer 2 | 100.00 | 100.00 | 100.00 | 100.00 | 100.00 |

TABLE 4c

| Ingredients LAYER 3 | Tablet n°3 (% by weight of the layer) | Tablet n°4 (% by weight of the layer) | Tablet n°5 (% by weight of the layer) | Tablet n°6 (% by weight of the layer) | Tablet n°7 (% by weight of the layer) |
|---|---|---|---|---|---|
| SODIUM CARBONATE | 13.10 | 13.10 | 13.10 | 13.10 | 13.10 |
| SODIUM SILICATE | 8.80 | 8.80 | 8.80 | 8.80 | 8.80 |
| TRISODIUM CITRATE 2(H2O) | 27.80 | 27.80 | 27.80 | 27.80 | 27.80 |

TABLE 4c-continued

| Ingredients LAYER 3 | Tablet n°3 (% by weight of the layer) | Tablet n°4 (% by weight of the layer) | Tablet n°5 (% by weight of the layer) | Tablet n°6 (% by weight of the layer) | Tablet n°7 (% by weight of the layer) |
|---|---|---|---|---|---|
| Lemon fragrance | 0.06 | 0.06 | 0.06 | 0.06 | 0.06 |
| LUTENSOL AT50 (Non-ionic surfactant sold by the BASF company) | 2.98 | 2.98 | 2.98 | 2.98 | 2.98 |
| SODIUM CHLORIDE | 29.85 | 29.85 | 29.85 | 29.85 | 29.85 |
| ARBOCEL TF 0210 | 0.86 | 0.86 | 0.86 | 0.86 | 0.86 |
| TAED | 4.00 | 4.00 | 4.00 | 4.00 | 4.00 |
| CATALYST | 0.76 | 0.76 | 0.76 | 0.76 | 0.76 |
| PROTEASE | 4.65 | 4.65 | 4.65 | 4.65 | 4.65 |
| AMYLASE | 0.78 | 0.78 | 0.78 | 0.78 | 0.78 |
| PEG 1500 | 6.13 | 6.13 | 6.13 | 6.13 | 6.13 |
| BLUE COLORANT E133 LAKE | 0.03 | 0.03 | 0.03 | 0.03 | 0.03 |
| GLYCERINE | 0.20 | 0.20 | 0.20 | 0.20 | 0.20 |
| TOTAL layer 3 | 100.00 | 100.00 | 100.00 | 100.00 | 100.00 |

For the tablets n°4, n°5, n°6 and n°7, a coating solution is sprayed on the surface of the tablets thereby formed in order to coat the tablet with a water-soluble coating.

Table 5 below specifies the composition of the coating solution used for these tablets n°4, n°5, n°6 and n°7.

TABLE 5

| Ingredients of coating solution | Tablet n°4 (% by weight) | Tablet n°5 (% by weight) | Tablet n°6 (% by weight) | Tablet n°7 (% by weight) |
|---|---|---|---|---|
| Polyvinyl alcohol | 47.90 | 47.90 | 45.84 | 45.84 |
| Water | 52.10 | 50.10 | 47.91 | 46.91 |
| Glycerine | 0 | 2.00 | 0 | 1.00 |
| Acusol 460 ND | 0 | 0 | 6.25 | 6.25 |
| TOTAL | 100.00 | 100.00 | 100.00 | 100.00 |

For the tablets n°4 and n°5, a uniform coating of 0.4 g of coating solution is deposited on the surface of the tablet in order to form a uniform coating.

For the tablets n°6 and n°7, a uniform coating of 0.465 g of coating solution is deposited on the surface of the tablet in order to form a uniform coating.

Each of the tablets n°3, n°4, n°5, n°6 and n°7 thereby manufactured comprises the same amount of anti-spotting agent, namely 0.029 g of product "Acusol 460 ND".

Table 6 below summarises the parameters for manufacturing different tablets, and gives the hardness and disintegration measurements of each of the tablets, it being understood that these parameters were measured in the same way as for test 1.

TABLE 6

| | Tablet n°3 | Tablet n°4 | Tablet n°5 | Tablet n°6 | Tablet n°7 |
|---|---|---|---|---|---|
| Weight layer 1 (g) | 6 | 6 | 6 | 6 | 6 |
| Weight layer 2 (g) | 5 | 5 | 5 | 5 | 5 |
| Weight layer 3 (g) | 5 | 5 | 5 | 5 | 5 |

TABLE 6-continued

| | Tablet n°3 | Tablet n°4 | Tablet n°5 | Tablet n°6 | Tablet n°7 |
|---|---|---|---|---|---|
| Pre-compressive force applied to layer 1 (kN) | 20 | 30 | 30 | 30 | 30 |
| Pre-compressive force applied to layer 2 (kN) | 20 | 20 | 20 | 20 | 20 |
| Compressive force applied to layer 3 (kN) | 60 | 30 | 30 | 30 | 30 |
| Tablet hardness (N) | 135 | 52 | 51 | 48 | 49 |
| Disintegration time (min:sec) of the tablet without coating | 7 min: 30 sec | 4 min: 40 sec | 4 min: 30 sec | 4 min: 10 sec | 4 min: 05 sec |

Tests were furthermore carried out in order to evaluate for each of the tablets n°3, n°4, n°5, n°6 and n°7 the efficiency in terms of associated rinsing.

The tests for measuring the efficiency in terms of rinsing of the tablets were carried out with a Fagor LFF-041 brand dishwasher programmed according to a short wash cycle (30 minutes) at 35° C. and with a water hardness of 35° TH.

For this test, 4 glass cups are placed on the upper compartment of the dishwasher at the start of the washing cycle. A soiling ballast is also placed in the dishwasher.

The efficiency in terms of rinsing of the tablets is evaluated by observation of the glass using a caisson provided with spots.

Spotting is measured after a washing cycle. Spotting is evaluated on a scale from 0 and 7, where 0 is the worst score (inefficient rinsing) and 7 is the best score (very efficient rinsing).

Filming is measured after 5 successive washing cycles. Filming is evaluated by observation of the cloudiness on the glasses. Filming is evaluated on a scale from 0 and 10, where 0 is the worst score (inefficient rinsing) and 10 is the best score (very efficient rinsing).

Brightness is evaluated after 1 washing cycle. Brightness is evaluated on a scale from 0 to 10, where 0 is the worst score (inefficient rinsing) and 10 is the best score (very efficient rinsing).

The results of the comparative tests are summarised in table 7 below.

TABLE 7

| | Coating | Spotting | Filming | Brightness |
|---|---|---|---|---|
| Tablet n°3 | NO | 5 | 9 | 10 |
| Tablet n°4 | YES without Acusol 460ND | 5.5 | 9 | 10 |
| Tablet n°5 | YES without Acusol 460ND | 5.5 | 9 | 10 |
| Tablet n°6 | YES with Acusol 460ND | 6.5 | 9 | 10 |
| Tablet n°7 | YES with Acusol 460ND | 6.5 | 9 | 10 |

It may be noted that the tablets n°5 and n°6 have better spotting results than the tablets n°3, n°4 and n°5.

The addition of the anti-spotting agent (Acusol 460 ND) in the coating solution thus makes it possible to increase the efficiency in terms of rinsing on spotting in short cycle.

The rapid dispersion of the anti-spotting agent (Acusol 460 ND) in the washing solution in fact makes it possible to improve the efficiency on the spotting of the tablet.

Test 3: Use of an Anti-Spotting Polymer in the Coating Solution for Improving the Stability of a Dishwasher Tablet The objective of this test is to evaluate the influence of the use of a coating integrating an anti-spotting agent on the stability of the tablets.

Comparative measurements were carried out on the following dishwasher tablets:

- a non-coated dishwasher tablet which is individually packed in a water-soluble package, of water-soluble Flowpack type (tablet n°8);
- a coated dishwasher tablet, where the coating solution does not contain anti-spotting agent. The coating solution is composed of polyvinyl alcohol and water (tablet n°9);
- a coated dishwasher tablet, where the coating solution does not contain anti-spotting agent. The coating solution is composed of polyvinyl alcohol, water, and a humectant (tablet n°10);
- a dishwasher tablet coated with a coating solution containing an anti-spotting agent. The coating solution is composed of polyvinyl alcohol, water, and the anti-spotting agent (tablet n°11);
- a dishwasher tablet coated with a coating solution containing an anti-spotting agent. The coating solution is composed of polyvinyl alcohol, water, a humectant and the anti-spotting agent (tablet n°12).

The anti-spotting agent used for this comparative test is the product referenced "Acusol 460ND" sold by the Dow Chemical company.

The compounds used in the formula of each tablet are spread out in three layers. The compounds of the different layers are indicated in tables 8a, 8b and 8c below.

The different layers of the tablet are compressed on a hydraulic press in such a way as to form a tablet having an overall weight of 16 g. The pre-compressive and compressive forces used are indicated in table 10 below.

TABLE 8a

| Ingredients LAYER 1 | Tablet n°8 (% by weight of the layer) | Tablet n°9 (% by weight of the layer) | Tablet n°10 (% by weight of the layer) | Tablet n°11 (% by weight of the layer) | Tablet n°12 (% by weight of the layer) |
|---|---|---|---|---|---|
| SODIUM CARBONATE | 11.80 | 11.80 | 11.80 | 11.80 | 11.80 |
| TRISODIUM CITRATE 2(H2O) | 40.45 | 40.45 | 40.45 | 40.45 | 40.45 |
| SODIUM PERCARBONATE | 23.27 | 23.27 | 23.27 | 23.27 | 23.27 |
| SODIUM CHLORIDE | 14.56 | 14.56 | 14.56 | 14.56 | 14.56 |
| LUTENSOL AT50 (Non-ionic surfactant sold by the BASF company) | 2.98 | 2.98 | 2.98 | 2.98 | 2.98 |

TABLE 8a-continued

| Ingredients LAYER 1 | Tablet n°8 (% by weight of the layer) | Tablet n°9 (% by weight of the layer) | Tablet n°10 (% by weight of the layer) | Tablet n°11 (% by weight of the layer) | Tablet n°12 (% by weight of the layer) |
|---|---|---|---|---|---|
| ARBOCEL TF 0210 | 0.86 | 0.86 | 0.86 | 0.86 | 0.86 |
| PEG 1500 | 5.00 | 5.00 | 5.00 | 5.00 | 5.00 |
| SODIUM HEDPHOSPHONATE | 0.88 | 0.88 | 0.88 | 0.88 | 0.88 |
| GLYCERINE | 0.20 | 0.20 | 0.20 | 0.20 | 0.20 |
| TOTAL layer 1 | 100.00 | 100.00 | 100.00 | 100.00 | 100.00 |

TABLE 8b

| Ingredients LAYER 2 | Tablet n°8 (% by weight of the layer) | Tablet n°9 (% by weight of the layer) | Tablet n°10 (% by weight of the layer) | Tablet n°11 (% by weight of the layer) | Tablet n°12 (% by weight of the layer) |
|---|---|---|---|---|---|
| SODIUM CARBONATE | 11.77 | 11.77 | 11.77 | 11.77 | 11.77 |
| TRISODIUM CITRATE 2(H2O) | 40.45 | 40.45 | 40.45 | 40.45 | 40.45 |
| SODIUM PERCARBONATE | 23.27 | 23.27 | 23.27 | 23.27 | 23.27 |
| SODIUM CHLORIDE | 14.56 | 14.56 | 14.56 | 14.56 | 14.56 |
| LUTENSOL AT50 (Non-ionic surfactant sold by the BASF company) | 2.98 | 2.98 | 2.98 | 2.98 | 2.98 |
| ARBOCEL TF 0210 | 0.86 | 0.86 | 0.86 | 0.86 | 0.86 |
| PEG 1500 | 5.00 | 5.00 | 5.00 | 5.00 | 5.00 |
| SODIUM HEDPHOSPHONATE | 0.88 | 0.88 | 0.88 | 0.88 | 0.88 |
| COLORANT TARTRAZINE E102 MD LA | 0.03 | 0.03 | 0.03 | 0.03 | 0.03 |
| GLYCERINE | 0.20 | 0.20 | 0.20 | 0.20 | 0.20 |
| TOTAL layer 2 | 100.00 | 100.00 | 100.00 | 100.00 | 100.00 |

TABLE 8c

| Ingredients LAYER 3 | Tablet n°8 (% by weight of the layer) | Tablet n°9 (% by weight of the layer) | Tablet n°10 (% by weight of the layer) | Tablet n°11 (% by weight of the layer) | Tablet n°12 (% by weight of the layer) |
|---|---|---|---|---|---|
| SODIUM CARBONATE | 13.10 | 13.10 | 13.10 | 13.10 | 13.10 |
| SODIUM SILICATE | 8.80 | 8.80 | 8.80 | 8.80 | 8.80 |
| TRISODIUM CITRATE 2(H2O) | 27.80 | 27.80 | 27.80 | 27.80 | 27.80 |
| Fragrance citron | 0.06 | 0.06 | 0.06 | 0.06 | 0.06 |
| LUTENSOL AT50 (Non-ionic surfactant sold by the BASF company) | 2.98 | 2.98 | 2.98 | 2.98 | 2.98 |
| SODIUM CHLORIDE | 29.85 | 29.85 | 29.85 | 29.85 | 29.85 |
| ARBOCEL TF 0210 | 0.86 | 0.86 | 0.86 | 0.86 | 0.86 |

TABLE 8c-continued

| Ingredients LAYER 3 | Tablet n°8 (% by weight of the layer) | Tablet n°9 (% by weight of the layer) | Tablet n°10 (% by weight of the layer) | Tablet n°11 (% by weight of the layer) | Tablet n°12 (% by weight of the layer) |
|---|---|---|---|---|---|
| TAED | 4.00 | 4.00 | 4.00 | 4.00 | 4.00 |
| CATALYST | 0.76 | 0.76 | 0.76 | 0.76 | 0.76 |
| PROTEASE | 4.65 | 4.65 | 4.65 | 4.65 | 4.65 |
| AMYLASE | 0.78 | 0.78 | 0.78 | 0.78 | 0.78 |
| PEG 1500 | 6.13 | 6.13 | 6.13 | 6.13 | 6.13 |
| BLUE COLORANT E133 LAKE | 0.03 | 0.03 | 0.03 | 0.03 | 0.03 |
| GLYCERINE | 0.20 | 0.20 | 0.20 | 0.20 | 0.20 |
| TOTAL layer 3 | 100.00 | 100.00 | 100.00 | 100.00 | 100.00 |

Each of the tablets n°8 manufactured are individually packed in a water-soluble Flowpack. Such a water-soluble Flowpack is a package made of polyvinyl alcohol, of 35 μm thickness, such as for example the product referenced "L711" sold by the MonoSol company.

For the tablets n°9, n°10, n°11 and n°12, a coating solution is sprayed on the surface of the tablets thereby formed in order to coat the tablet with a water-soluble coating. For these tablets, a uniform coating of 0.5 g of coating solution is deposited on the surface of the tablet in order to form a uniform coating.

Table 9 below specifies the composition of the coating solution used for these tablets n°9, n°10, n°11 and n°12.

TABLE 9

| Ingredients of coating solution | Tablet n°9 (% by weight) | Tablet n°10 (% by weight) | Tablet n°11 (% by weight) | Tablet n°12 (% by weight) |
|---|---|---|---|---|
| Polyvinyl alcohol | 47.90 | 47.90 | 45.84 | 45.84 |
| Water | 52.10 | 50.10 | 47.91 | 46.91 |
| Glycerine | 0 | 2.00 | 0 | 1.00 |
| Acusol 460 ND | 0 | 0 | 6.25 | 6.25 |
| TOTAL | 100.00 | 100.00 | 100.00 | 100.00 |

Table 10 below summarises the manufacturing parameters of the different tablets, and gives the hardness and disintegration measurements of each of the tablets, it being understood that these parameters were measured in the same way as for test 1.

TABLE 10

| | Tablet n°8 | Tablet n°9 | Tablet n°10 | Tablet n°11 | Tablet n°12 |
|---|---|---|---|---|---|
| Weight layer 1 (g) | 6 | 6 | 6 | 6 | 6 |
| Weight layer 2 (g) | 5 | 5 | 5 | 5 | 5 |
| Weight layer 3 (g) | 5 | 5 | 5 | 5 | 5 |
| Pre-compressive force applied to layer 1 (kN) | 20 | 30 | 30 | 30 | 30 |
| Pre-compressive force applied to layer 2 (kN) | 20 | 20 | 20 | 20 | 20 |

TABLE 10-continued

| | Tablet n°8 | Tablet n°9 | Tablet n°10 | Tablet n°11 | Tablet n°12 |
|---|---|---|---|---|---|
| Pre-compressive force applied to layer 3 (kN) | 60 | 30 | 30 | 30 | 30 |
| Hardness tablet (N) | 135 | 50 | 49 | 51 | 50 |
| Disintegration time (min:sec) of the tablet without coating and without flowpack | 7 min 20 sec | 4 min 52 sec | 4 min 50 sec | 5 min 00 sec | 5 min 05 sec |

For test 3, 5 examples of each of tablets n°8, n°9, n°10, n°11 and n°12 are used and these 5 examples are placed in a flexible bag, the shape of which is provided so that the bag can stand up on its own, for example a Doypack type bag.

Each flexible bag containing the 5 examples of each of the different tablets is next placed in a climate controlled chamber at 38° C. and 70% relative humidity for 2 weeks.

After said 2 weeks spent in the climate controlled chamber, each of the tablets is tested in order to examine the visual appearance and to measure the disintegration time of each type of tablet.

The results obtained are summarised in table 11 below.

TABLE 11

| | Tablet n°8 | Tablet n°9 | Tablet n°10 | Tablet n°11 | Tablet n°12 |
|---|---|---|---|---|---|
| Appearance of tablet | Presence of several blisters and start of lamellisation | Presence of several blisters and start of lamellisation | Presence of several blisters and start of lamellisation | Good visual appearance, absence of blisters and absence of lamellisation | Good visual appearance, absence of blisters and absence of lamellisation |
| Disintegration time (mm:sec) | 7 min: 40 sec | 8 min: 10 sec | 8 min: 00 sec | 9 min: 00 sec | 8 min: 55 sec |

It may be noted that the appearance of the tablets n°11 and n°12 has not been altered compared to the tablets n°8, n°9 and n°10 which have several blisters and a start of lamellisation after two weeks in a climate chamber. This proves that the coating integrating the specific agent for improving the efficiency in terms of rinsing manages, in a surprising manner, to improve the stability of the tablet, including compared to a tablet also having a coating but which does not include the specific agent.

Furthermore, it may be observed that the disintegration time of the tablets n°11 and n°12 is compliant and substantially identical to the disintegration time of the other types of tablets.

BIBLIOGRAPHIC REFERENCES

U.S. Pat. No. 3,231,505
WO 01/64829
EP 2 196 531

What is claimed is:

1. A detergent tablet comprising a body made from compacted powder, said body being coated with a water-soluble coating, said water-soluble coating being obtained by depositing a liquid coating composition comprising a film-forming agent, water, and at least one agent selected from the group consisting of copolymers of acrylic acid and sulphonated monomer, copolymers of acrylic acid and sulphonic acid; and combinations thereof.

2. The detergent tablet of claim 1, wherein the water-soluble coating has a thickness comprised between 1 μm and 1,000 μm.

3. The detergent tablet of claim 1, wherein the water-soluble coating has a weight representing between 0.5% to 15% by weight compared to the total weight of the detergent tablet.

4. The detergent tablet of claim 1, wherein the at least one agent is in a proportion comprised between 0.05% and 50% by weight compared to the total weight of the liquid composition of the water-soluble coating.

5. The detergent tablet of claim 1, wherein the film-forming agent is in a proportion comprised between 5% and 80% by weight compared to the total weight of the liquid composition of the water-soluble coating.

6. The detergent tablet of claim 1, wherein the film-forming agent is selected from polyvinyl alcohols.

7. The detergent tablet of claim 6, wherein the film-forming agent is selected from polyvinyl alcohols having a hydrolysis level with a molar percentage greater than or equal to 40%.

8. The detergent tablet of claim 6, wherein the film-forming agent is selected from polyvinyl alcohols having a molar mass by weight comprised between 10,000 g/mol and 200,000 g/mol.

9. The detergent tablet of claim 1, wherein the liquid coating composition further comprises a humectant.

10. The detergent tablet of claim 9, wherein the humectant is in a proportion less than or equal to 25% by weight compared to the total weight of the liquid composition of the water-soluble coating.

11. The detergent tablet of claim 10, wherein the humectant is selected from glycerine, polyethylene glycols, and combinations thereof.

12. The detergent tablet of claim 10, wherein the humectant is selected from polyethylene glycols having a molar mass by weight comprised between 1,000 g/mol and 4,000 g/mol.

13. The detergent tablet of claim 1, wherein the water-soluble coating has a thickness comprised between 5 μm and 300 μm.

14. The detergent tablet of claim 1, wherein the water-soluble coating has a thickness comprised between 15 μm and 150 μm.

15. The detergent tablet of claim 1, wherein the water-soluble coating has a weight representing between 2% to 5% by weight compared to the total weight of the detergent tablet.

16. The detergent tablet of claim 1, wherein the at least one agent is in a proportion comprised between 2% and 20% by weight compared to the total weight of the liquid composition of the water-soluble coating.

17. The detergent tablet of claim 1, wherein the film-forming agent is in a proportion comprised between 20% and 60% by weight compared to the total weight of the liquid composition of the water-soluble coating.

18. The detergent tablet of claim 1, wherein the film-forming agent is in a proportion comprised between 30% and 55% by weight compared to the total weight of the liquid composition of the water-soluble coating.

19. The detergent tablet of claim 6, wherein the film-forming agent is selected from polyvinyl alcohols having a hydrolysis level with a molar percentage greater comprised between 70% and 98%.

20. The detergent tablet of claim 6, wherein the film-forming agent is selected from polyvinyl alcohols having a hydrolysis level with a molar percentage comprised between 80% and 90%.

21. The detergent tablet of claim 6, wherein the film-forming agent is selected from polyvinyl alcohols having a molar mass by weight comprised between 15,000 g/mol and 100,000 g/mol.

22. The detergent tablet of claim 9, wherein the humectant is in a proportion comprised between 1% and 20% by weight compared to the total weight of the liquid composition of the water-soluble coating.

23. The detergent tablet of claim 9, wherein the humectant is in a proportion comprised between 2% and 10% by weight compared to the total weight of the liquid composition of the water-soluble coating.

24. The detergent tablet of claim 1, wherein the liquid coating composition is sprayed on the body.

25. A detergent tablet comprising a body made from compacted powder, said body being coated with a water-soluble coating comprising a film-forming agent and at least one agent selected from the group consisting of copolymers of acrylic acid and sulphonated monomer, copolymers of acrylic acid and sulphonic acid; and combinations thereof.

26. The detergent tablet of claim 25, wherein the water-soluble coating has a thickness comprised between 1 μm and 1,000 μm.

27. The detergent tablet of claim 25, wherein the water-soluble coating has a weight representing between 0.5% to 15% by weight compared to the total weight of the detergent tablet.

28. The detergent tablet of claim 25, wherein the water-soluble coating further comprises a humectant.

* * * * *